United States Patent [19]

Gustafsson

[11] Patent Number: 5,068,079

[45] Date of Patent: Nov. 26, 1991

[54] METHOD FOR FORMING A DRY WEB ON THE WIRE

[75] Inventor: Helmer Gustafsson, Valkeakoski, Finland

[73] Assignee: Yhtyneet Paperitehtaat Oy Walkisoft Engineering, Valkeakoski, Finland

[21] Appl. No.: 590,459

[22] Filed: Sep. 26, 1990

Related U.S. Application Data

[63] Continuation of Ser. No. 209,376, Jun. 21, 1988, abandoned.

[30] Foreign Application Priority Data

May 20, 1988 [FI] Finland ..... 882401

[51] Int. Cl.[5] ..... B27N 3/04

[52] U.S. Cl. ..... 264/518; 264/517; 264/109; 264/114; 264/115; 264/121; 241/28

[58] Field of Search ..... 264/517, 518, 115, 114, 264/121; 209/670, 683, 690; 241/24, 28; 162/189, 202, 13, 55

[56] References Cited

U.S. PATENT DOCUMENTS

| | | | |
|---|---|---|---|
| 4,218,414 | 8/1980 | Hagg et al. | 264/115 |
| 4,278,113 | 7/1981 | Persson | 141/1 |
| 4,353,509 | 10/1982 | Bostian, Jr. | 162/55 |
| 4,562,969 | 1/1986 | Lindahl | 162/55 |

FOREIGN PATENT DOCUMENTS

| | | | |
|---|---|---|---|
| 1278202 | 9/1968 | Fed. Rep. of Germany | 209/683 |
| 61223 | 6/1982 | Finland . | |
| 66948 | 8/1984 | Finland . | |
| 8102031 | 7/1981 | World Int. Prop. O. . | |

*Primary Examiner*—Hubert C. Lorin
*Attorney, Agent, or Firm*—Browdy and Neimark

[57] ABSTRACT

A method for forming a dry web on the wire, with the fibre material being fed into at least one perforated drumlike forming element that covers essentially the whole width of the web to be formed, in which forming element fibres are conveyed in the drum along the width of the web and screened through the mantle of the forming element onto the wire. To achieve such web formation as has as few disturbances as possible, the fibre material is fed into the drumlike forming element in such a way that the bulk of the fibres, when advancing in the feeding direction toward the other end of the forming element, get screened from the forming element onto the wire, and that those fibres that do not get screened, but travel through the forming element are removed from the forming element and returned for a new defibration.

5 Claims, 2 Drawing Sheets

METHOD FOR FORMING A DRY WEB ON THE WIRE

Figure 1:
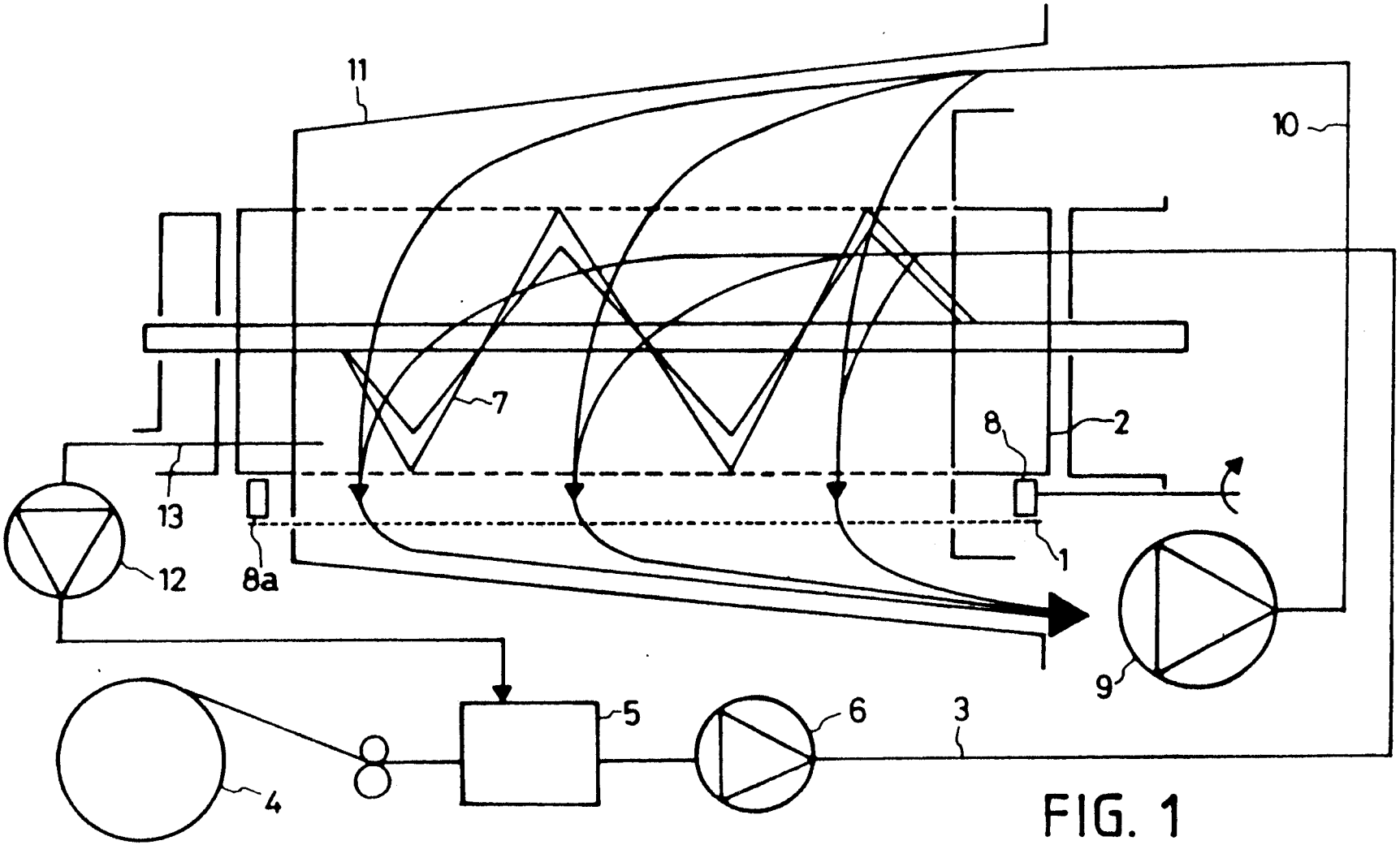

This application is a continuation of application Ser. No. 07/209,376, filed Jun. 21, 1988 now abandoned.

This invention is related to a method and an apparatus for forming a dry web on the wire, with the fibre material being fed into at least one perforated drumlike forming element that covers essentially the whole width of the web to be formed, in which forming element fibres are in an in itself known method conveyed in the drum along the width of the web and screened through the mantle of the forming element onto the wire.

Apparatuses for dry formation generally comprise a tanklike or tubular treatment space, into which the web-forming fibre material is fed with air stream. In these apparatuses an even distribution of fibre material is sought by recirculating fibre material and by spreading it into a layer of even thickness on the forming wire. This can be done either by mechanically agitating the fibre material, as described in Finnish Patent Publication No. 61223, or by recirculating fibre material in a piping, as described in Finnish Patent Publication No. 66948, while at the same time there is suction through the screen surfaces, taking onto the wire those fibres that have passed through the screen surface.

Known apparatuses have the drawback that when remaining longer in the forming apparatus, as happens in recirculation, fibres eventually form lumps that are not able to get through the screen surfaces, in other words they flocculate. Such fibre lumps cause blockages in the apparatus and finally serious disturbances in the forming process.

The object of this invention is to eliminate the above-mentioned disadvantages and create a method for forming a dry web on the wire, free of those disadvantages. To achieve this, a method according to the invention is characterized by that the fibre material is fed into the drumlike forming element in such a way that the bulk of the fibres, when advancing in the feeding direction toward the other end of the forming element, get screened from the forming element onto the wire, and that those fibres that do not get screened, but travel through the forming element are removed from the forming element and returned for a new defibration.

Other advantageous embodiments of a method according to the invention are characterized by what is presented in the patent claims below.

An apparatus for applying a method according to the invention, which apparatus includes at least one perforated cylindrical forming drum that covers essentially the whole width of the web to be formed, is characterized by that the feeding of the fibre material into the forming drum is done with such an air pressure that the fibres drop onto the surface of the drum's mantle, which is affected by at least one in itself known element for agitating the fibres, and that at that drum end which is opposite to the feeding inlet there is an outlet for unscreened fibre material.

Other advantageous embodiments of an apparatus according to the invention are characterized by what is presented in the patent claims below.

In the following, the invention is explained in more detail with reference to the attached drawings, in which FIG. 1 shows an embodiment of an apparatus according to the invention.

Figure 2:
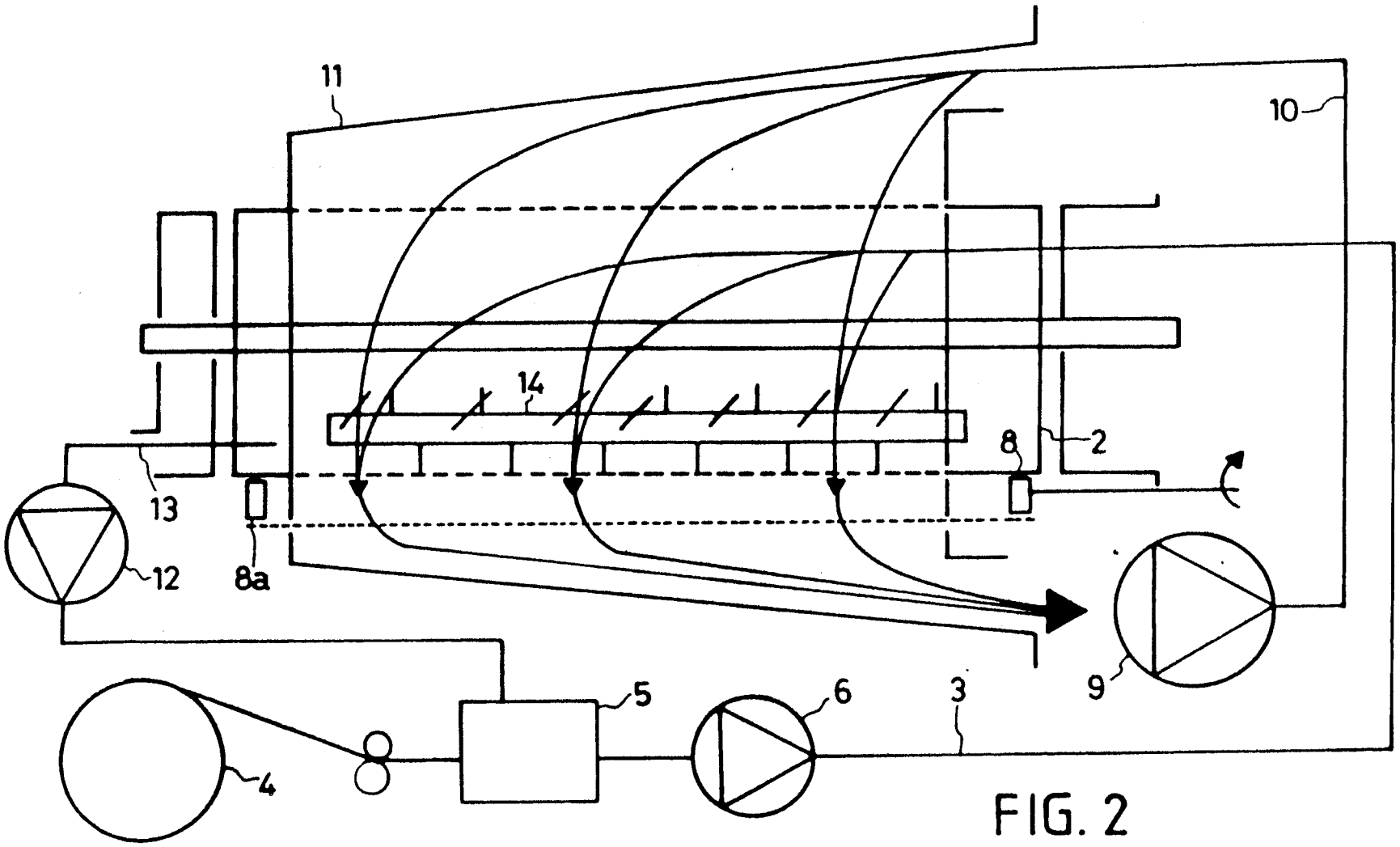

FIG. 2 shows another embodiment of an apparatus according to the invention.

FIG. 1 shows an apparatus according to the invention, through which a forming wire 1 runs at right angles to the plane of the picture. The apparatus comprises a cylindrical forming drum 2 with a perforated mantle, which forming drum is rotated and supported with friction rolls 8 and 8a. Fibre material is fed into the drum 2 through a pipe 3. In this case the wood fibres are produced by that chemical pulp 4 existing in a suitable form is torn in a defibrator 5, which is for instance a hammer mill. A blower 6 gives the air pressure required for injecting the fibre material into the forming drum 2 with as suitable a dispersion as possible. That dispersion has to be determined experimentally, the goal being that the web formed on the wire be as even in quality as possible, without having excessive quantities of fibre material leave at the other end of the drum 2. By varying the air pressure it is possible to get the main fraction of the fibre material to the desired location in the forming drum; that location depends first of all on the transporting characteristics of the elements for dispersing and agitating the fibres, situated inside and outside the drum.

In the drum 2 rotates in this example a conveyor screw 7, which in the figure is shown with one thread, but which can also have more threads. Moreover, the threads can be cut ones. The conveyor screw is rotated in the opposite direction as compared to the direction of rotation of the drum 2 and, sweeping the inner surface of the drum mantle, carries fibre material along the surface of the drum 2 for achieving as effective a screening as possible. The screened fibre material moves onto the wire 1, and it has been aranged that a blower 9 produces suction through the wire. The air removed this way builds for the apparatus a secondary circuit of air, which, fed through a pipe 10, is directed from above between the drum 2 and its housing 11 onto the screening mantle surface to clear blockages there.

Fibres and fibre lumps which during their travel, in the figure from right to left, through the drum 2 have not time or cannot get screened onto the wire 1 are removed at the left end of the drum, where there is for this purpose a hole of suitable size, or else the drum is open and has been extended somewhat over the width of the web. The fibre amount leaving this way can vary within 0 to 20 percent of the amount that has been fed in, in other words the production flow of fibres, ever according to the situation and the equipment available. It can be influenced at least by changing the fibre material feeding pressure and by varying the speeds of the forming drum and the conveyor screw. The discharge flow is blown with a blower through a pipe 13 back to the defibrator 5 for a new defibration.

From the videwpoint of the invention, critical for the forming of a dry web are thus on one hand a sufficiently accurate control of the fibre material at the feeding-in stage and on the other hand as effective a screening as possible at the stage where the material advances along the drum. In the invention, that can be realized on one hand so that the air pressure for feeding the fibre material in is, ever according to the dimensions of the forming drum 2 and to the fibre processing devices connected to it, suitably adjusted in such a way that already upon entering the drum the fibre material gets placed as advantageously as possible in view of an efficient screening along the whole effective length of the drum, and on the other hand by providing as effective a ruffling of the fibres as possible in the screening area and as effective a cleaning of the screening surfaces as possible elsewhere.

An apparatus according to FIG. 1 can also work without either the conveyor screw or the secondary circuit of air, provided the primary air, in other words the air stream for feeding in the fibres, is accordingly adjusted and that the forming drum 2 rotates. In the case of a stationary drum 2, it is normally not possible to leave out the conveyor screw or the secondary circuit of air.

FIG. 2 shows another embodiment of the invention; in it one or more well-known spike rollers are used for the cleaning of the mantle of the forming drum and for the stirring of the fibre material. The function of the spikes on the roller 14 schematically shown as an example in FIG. 2, which most advantageously rotates in the opposite direction as compared to the direction of rotation of the forming drum 2, is to stir the fibre material in the drum 2 and keep the perforation of the drum mantle unblocked. Unlike the conveyor screw, the spike roller has no actual fibre-material transporting function. Except being equipped with a spike roller 14 instead of a conveyor screw 7, the apparatus is like that shown in FIG. 1. To the spike roller 14, which is shown very schematically in FIG. 2, apply the same observations about the necessity of the secondary circuit of air and the drum's 2 being rotary, as were made in connection with FIG. 1.

It is obvious to a person skilled in the art that the embodiments of the invention are not restricted to the examples given above, but can be varied within the scope of the following patent claims.

I claim:

1. In a process for forming a dry web on a wire, where wood fibers are fed to at least one perforated drumlike forming element from a defibrator stage of said process, which forming element covers essentially the whole width of the web to be formed, and in which said wood fibres are conveyed along the width of the web and screened through a mantle of said drumlike forming element onto said wire, wherein the improvement comprises the steps of;

feeding said wood fibers into the drumlike forming element;

screening the bulk of said fibres onto said wire as said fibres advance in the feeding direction towards the other end of said drumlike forming element;

removing the fiber bundles or lumps which do not get screened from said forming element; and returning said unscreened fiber bundles or lumps to an earlier process stage for defibration.

2. The process according to claim 1, wherein the drumlike forming element is rotated while the mantle surface of the forming element is being cleaned with an air jet.

3. The process according to claim 1, wherein the drumlike forming element is rotated while the mantle surface of the forming element is being cleaned with at least one spike roller rotating inside it.

4. The process according to claim 1, wherein the drumlike forming element is rotated while the mantle surface of the forming element is being cleaned with a conveyor screw and fibres conveyed with the same.

5. The process according to claim 1, wherein the drumlike forming element is stationary while the mantle surface of the forming element is being cleaned with an air jet directed against it and fibres conveyed with a conveyor screw.

* * * * *